US010159988B1

(12) United States Patent
Nelson

(10) Patent No.: US 10,159,988 B1
(45) Date of Patent: Dec. 25, 2018

(54) GOLD AND GEMSTONE WET OR DRY RECOVERY METHOD AND MACHINE

(71) Applicant: James Ray Nelson, Blackfoot, ID (US)

(72) Inventor: James Ray Nelson, Blackfoot, ID (US)

( * ) Notice: Subject to any disclaimer, the term of this patent is extended or adjusted under 35 U.S.C. 154(b) by 0 days.

(21) Appl. No.: 15/878,874

(22) Filed: Jan. 24, 2018

(51) Int. Cl.
*B03B 5/24* (2006.01)
*B03B 5/10* (2006.01)

(52) U.S. Cl.
CPC ..... *B03B 5/10* (2013.01)

(58) Field of Classification Search
CPC .... B03B 5/02; B03B 5/06; B03B 5/10; B03B 5/16; B03B 5/24; B03B 5/48; B03B 5/56; B03B 5/58
USPC ..... 209/475, 477
See application file for complete search history.

(56) References Cited

U.S. PATENT DOCUMENTS 849,553 A 4/1907 Michaelsen
1,986,778 A * 1/1935 Hinkley ..... B03B 5/62 209/444
2,029,090 A * 1/1936 Yewell ..... B03B 5/74 209/436
2,344,094 A * 3/1944 Kraut ..... B03B 5/16 209/455
4,008,152 A * 2/1977 Kleven ..... B03B 5/74 209/444
4,431,532 A * 2/1984 Wyke ..... B03B 5/16 137/624.14
4,561,973 A * 12/1985 Cleland ..... B03B 5/02 156/160
5,160,035 A * 11/1992 McConnell ..... B03B 5/02 209/439
5,447,239 A * 9/1995 Tubbs, Jr. ..... B03B 5/74 209/434

(Continued)

*Primary Examiner* — Joseph C Rodriguez

(57) ABSTRACT

A method and machine for the purpose of separating heavy materials from lighter materials by specific gravity. The machine consists of a vertical cylindrical body, supported on legs, and across the top a flexible diaphragm of appropriate material is draped, and fastened at the perimeter. The diaphragm forms a bowl-shaped depression, and is manipulated by a rotating assembly. The assembly having any number of arms, mounted in a fashion in which they are offset from the center of rotation, and extending radially nearly to the perimeter. The assembly is mounted on a vertical shaft which may be turned by a motor, or manually. The force of the arms, acting against the underside of the diaphragm, causes an upward projecting, moving wave in the diaphragm. Raw material is fed through a feed funnel to the center of the diaphragm, forming a conical pile. The pile is agitated by the moving wave, causing the heavier materials to sink down to the upper surface of the diaphragm while the lighter waste moves down and across the pile, and over the edge. The machine operates either with, or without water. The heavy materials, once in contact with the surface of the diaphragm, move down the slope of the diaphragm to the center. The heavy materials are encouraged to move more quickly and positively to the center by the offset nature of the arms, which cause a sweeping action to the materials in contact with the diaphragm. The sweeping action also assists in holding the heavy material at the center, and preventing its return to the waste stream.

6 Claims, 10 Drawing Sheets

(56) References Cited

Figure 1:
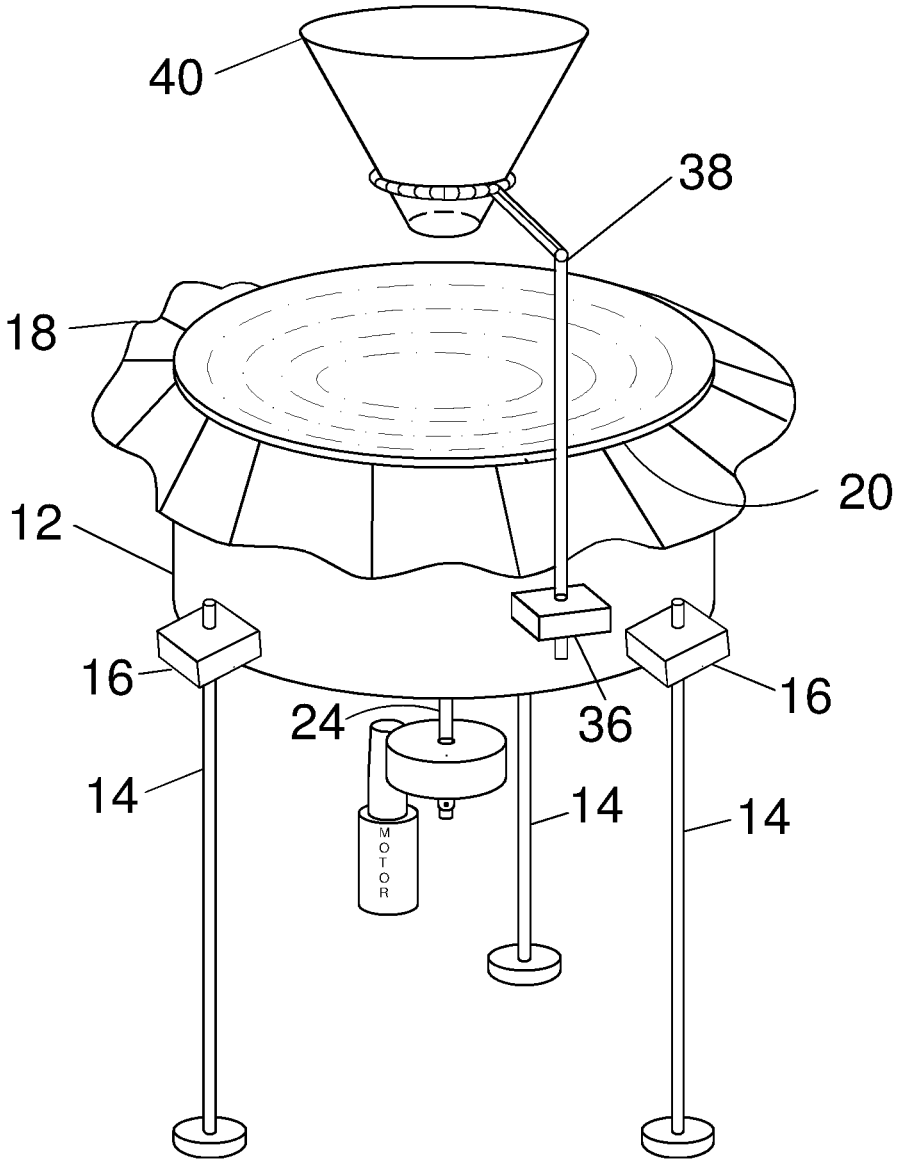

U.S. PATENT DOCUMENTS 5,788,293 A * 8/1998 Krenzler ..... B03B 5/74
209/434
6,612,443 B2 * 9/2003 Kelsey ..... B03B 5/10
209/425
8,057,685 B2 * 11/2011 Laing ..... B01D 29/6476
210/744

* cited by examiner

GOLD AND GEMSTONE WET OR DRY RECOVERY METHOD AND MACHINE

BACKGROUND

My machine relates to the field of jigs, dry washers, and rockers. which are particularly of use in the field of mining and mineral exploration, but in the case of jigs, may find use in other fields. In the case of jigs and rockers, the primary use is the recovery of desirable gemstones and precious metals contained in the raw material. Dry washers are only used for metals. Rockers may be used for either, but are primarily involved in gold mining.

PRIOR ART

The use of jigs in the mining industry is common and, for the most part, jigs use a pulsation of water to effect a lifting, separation, and agitation of the raw material. As the raw material settles following a pulse of water, the heavier fraction of the raw material settles faster. This differential settlement has the result of the heavier material sinking through the pulp or gangue to be retained at the bottom of the jig box, on top of the ragging, or passing through the ragging and screen, and into the hutch, where it is retained, while the lighter material is carried out of the jig by the water flowing through.

Jigs have three characteristics that limit their use. They requires large amounts of water. That limits their use in arid country. They also have a poor recovery ratio, that is the ratio of favorable material retained compared to the total raw material run through them, is poor. It's often necessary to run multiple jigs in series, to ensure a good recovery ratio. Jigs also require a high energy input as enough force is required to lift the weight of the gangue, as well as the weight of the water needed to lift the gangue. Jigs are effective at retaining even very fine flour gold, however, and also, with a correctly classified raw material feed, do very well at the recovery of gemstones.

In the use of dry washers I've noticed that the results on small, flour gold are poor. The nature of their operation requires a strong flow of air through the cloth bottom of the riffle tray. That flow of air often lifts the very small, flat gold particles back into the waste stream, and thus they are not retained.

Dry washers are also of no use in recovering gemstones, and require a high energy supply, as the separating medium is pressurized air.

Rockers are, in most cases hand operated. Their feed rate is slow, though they do a fair job on small gold, and in some instances can recover gems. They often used mercury, a dangerous chemical, to amalgamate the flour gold, as the final step in the recovery process. They also require, in most cases, two people to operate.

SUMMARY

This embodiment is a method and machine for the recovery of gold and gemstones. The machine is comprised of a cylindrical body supported by legs which are adjustable to level the body. Across the top of the body is attached a flexible diaphragm. The diaphragm is attached at the perimeter of the body. The diaphragm is allowed to sag down, forming a depression within the body.

Within the body, at a predetermined point is a rigid support member made up of a steel square tube. The tube has a vertical hole in the center large enough that a shaft through the hole may turn freely. Fastened to the member are bearing plates of UHMW plastic. The plates are drilled to be a close fit on a steel shaft. A shaft extends from below the member to a predetermined height below the top of the body. The shaft is turned by any appropriate means.

Attached to the shaft by a set screw is a thrust collar that rides against the top surface of the upper bearing plate. Sliding the shaft within the collar allows vertical adjustment of the shaft.

Attached to the upper end of the shaft is a lifting assembly. The assembly is comprised of a center hub, with a set screw for locking the assembly to the shaft. The assembly rotates with the shaft. The center hub is rectangular in shape. Attached to the hub, in this embodiment, are support arms of inverted angle irons. The support arms extend radially to, but not in contact with, the inside face of the body. The angles are attached with the legs of the angles down against the upper surface of the hub, leaving the legs at a 45 degree slope relative to the direction of rotation.

Attached to the leading leg of each support arm is a flat solid lifting surface of UHMW plastic.

Each surface extends above the corner formed by the legs of the angle irons, and each surface extends outwardly to the end of its support arm. The shaft is adjusted vertically so the upper edge of the lifting surface is in light contact with the bottom surface of the diaphragm.

The gold and gem recovery is enhanced if the contact edges of the lifting surfaces where they contact the diaphragm, are offset from the center of rotation. That offset makes any outward point, along the contact edge, lead any more inward point. That lead results in the diaphragm being lifted at any outward point before any more inward point. That increases the slope to center of the diaphragm, and results in a sweeping action that tends to drive the material in contact with the diaphragm towards the center of the depression formed by the diaphragm, and hold it there.

A supply funnel, in this embodiment, is mounted above the radial center of the circular body. The mounting is such that the funnel may be adjusted for vertical elevation above the diaphragm. In this embodiment, a block of steel, attached to the body, is used to mount the funnel support leg. The leg is bent such that one portion is vertical, and the other portion is horizontal. The vertical portion has a sliding mounting within the block, and can be locked in place with a set screw for which the block is drilled and tapped. The horizontal portion is attached to the funnel.

The operation of this embodiment consists of feeding a supply of pulp or gangue to the funnel, where it is directed to the center of the top surface of the diaphragm. The fed material forms a conical pile on the diaphragm. The rotation of the lifting assembly results in a rotating, upward-projecting ridge in the diaphragm. The revolving ridge results in a repeated lifting, separation, and agitation of the pulp or gangue the result of which is the heavier materials sink down through the pulp or gangue to the diaphragm. Once in contact with the diaphragm they move down the slope of the diaphragm. This movement down the diaphragm slope is opposite in direction to the movement of the waste material, which enhances the separation of the desired material from the waste. The heavy material ends up at the lowest point of the depression formed by the diaphragm. The offset-from-the-radial-center position of the arms results in an accelerated urging of the heavy material to the center. The lighter waste material remains above the diaphragm, and drifts down the slope of the pile to the perimeter, and then over the edge to the waste pile.

DRAWINGS—FIGURES

FIG. 1 An isometric view of the machine with no internal parts shown.

Figure 2:
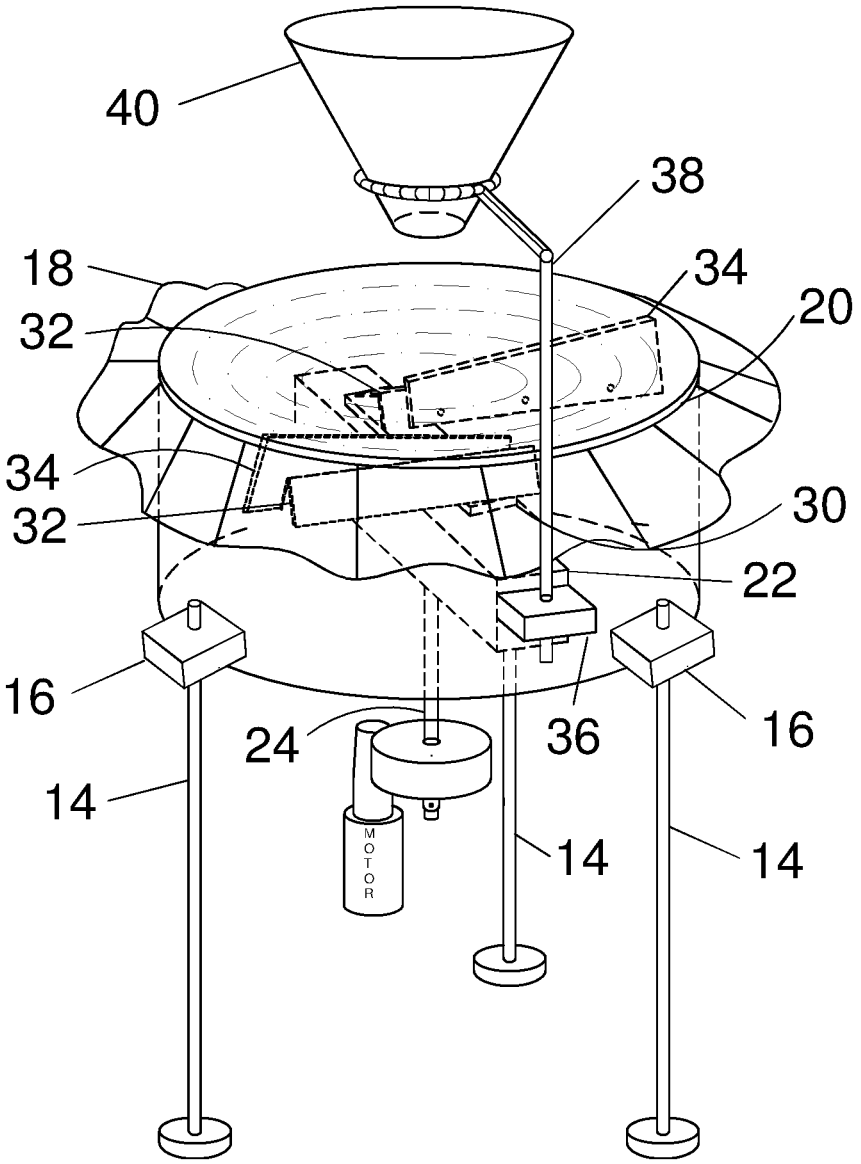

FIG. 2 An isometric view of the assembled machine, with the internal parts shown.

Figure 3:
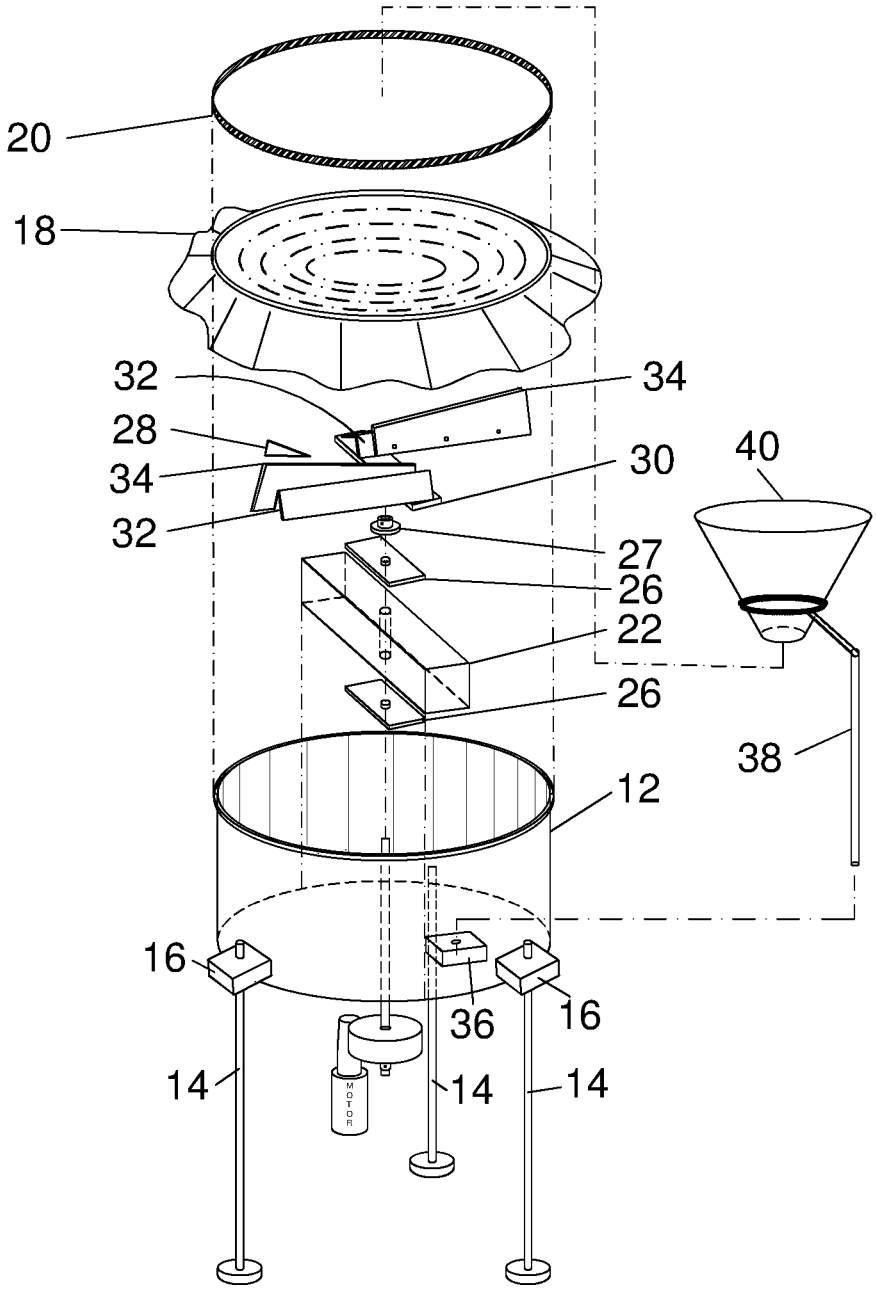

FIG. 3 An exploded isometric view of the machine showing parts.

Figure 4:
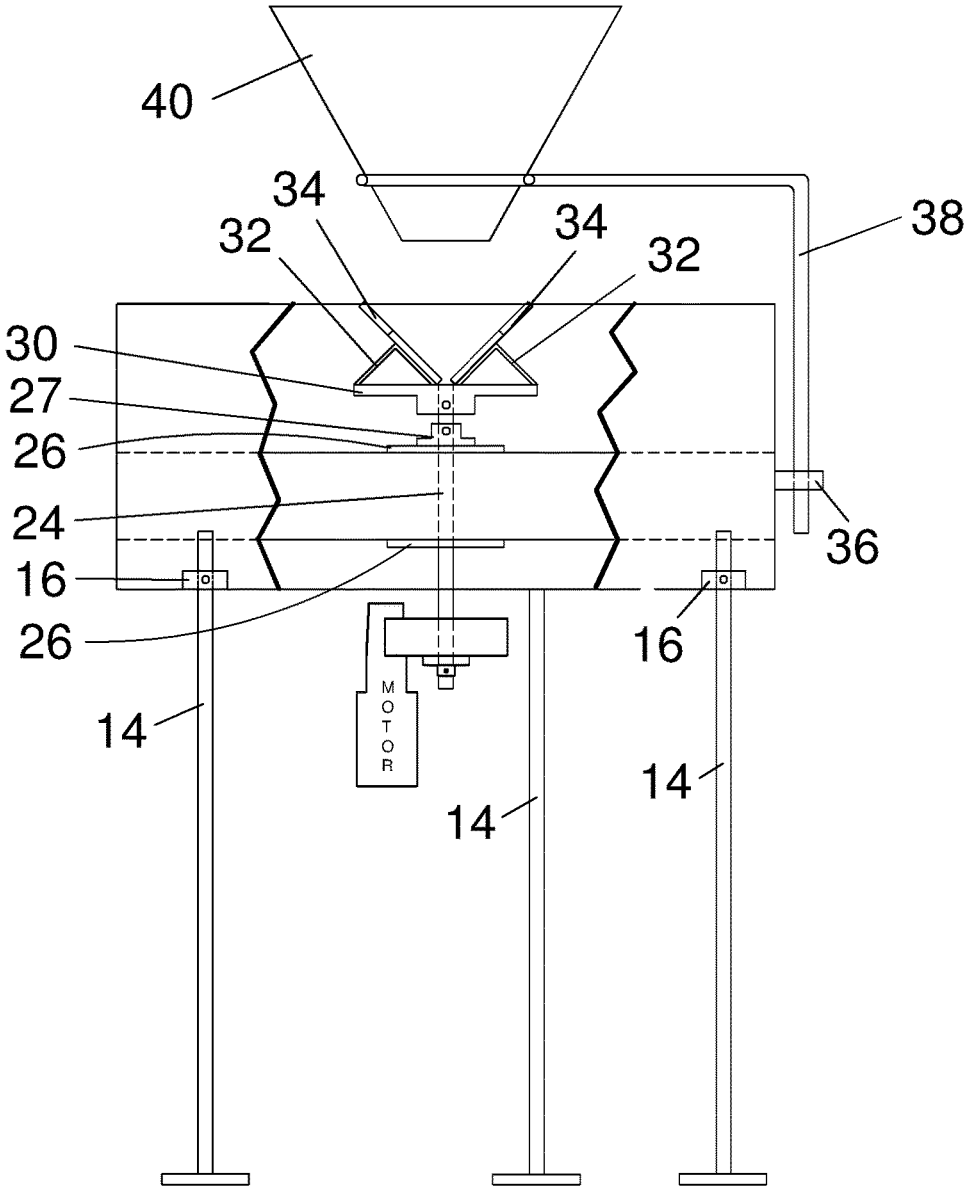

FIG. 4 An orthogonal view with cutaway window showing positioning of the parts.

Figure 5:
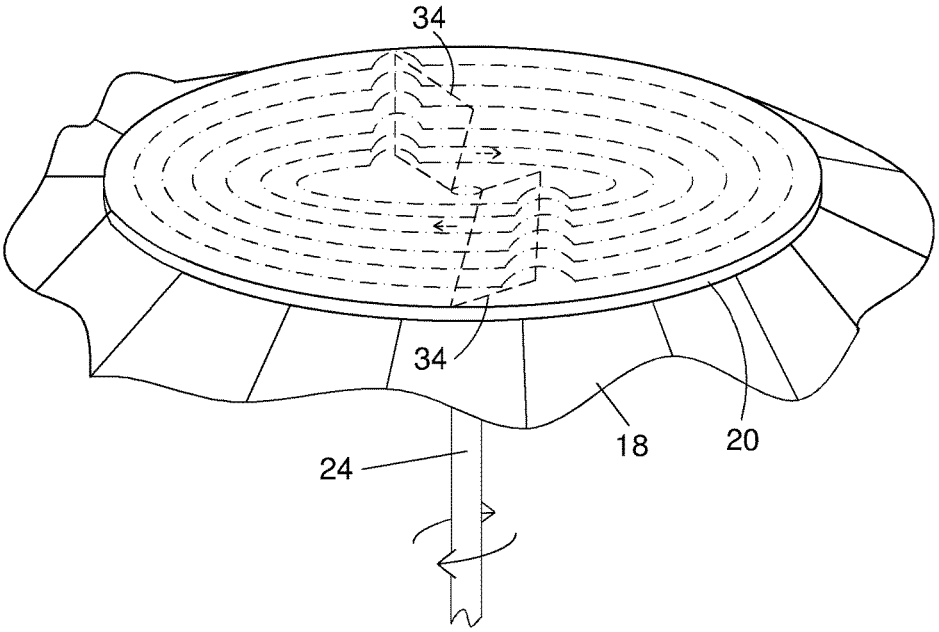

FIG. 5 An isometric view of the diaphragm with projecting ridges.

Figure 6:
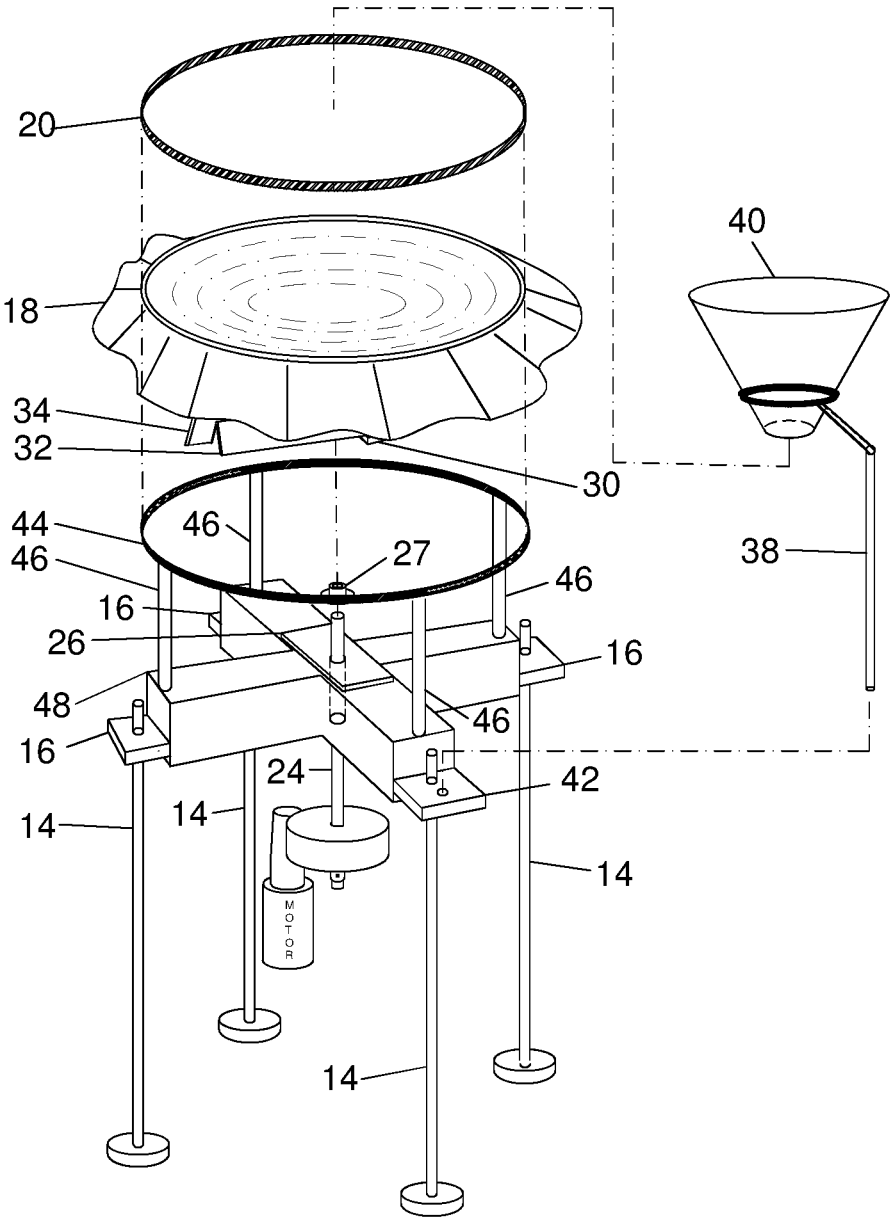

FIG. 6 An isometric view of a second embodiment with parts shown.

Figure 7:
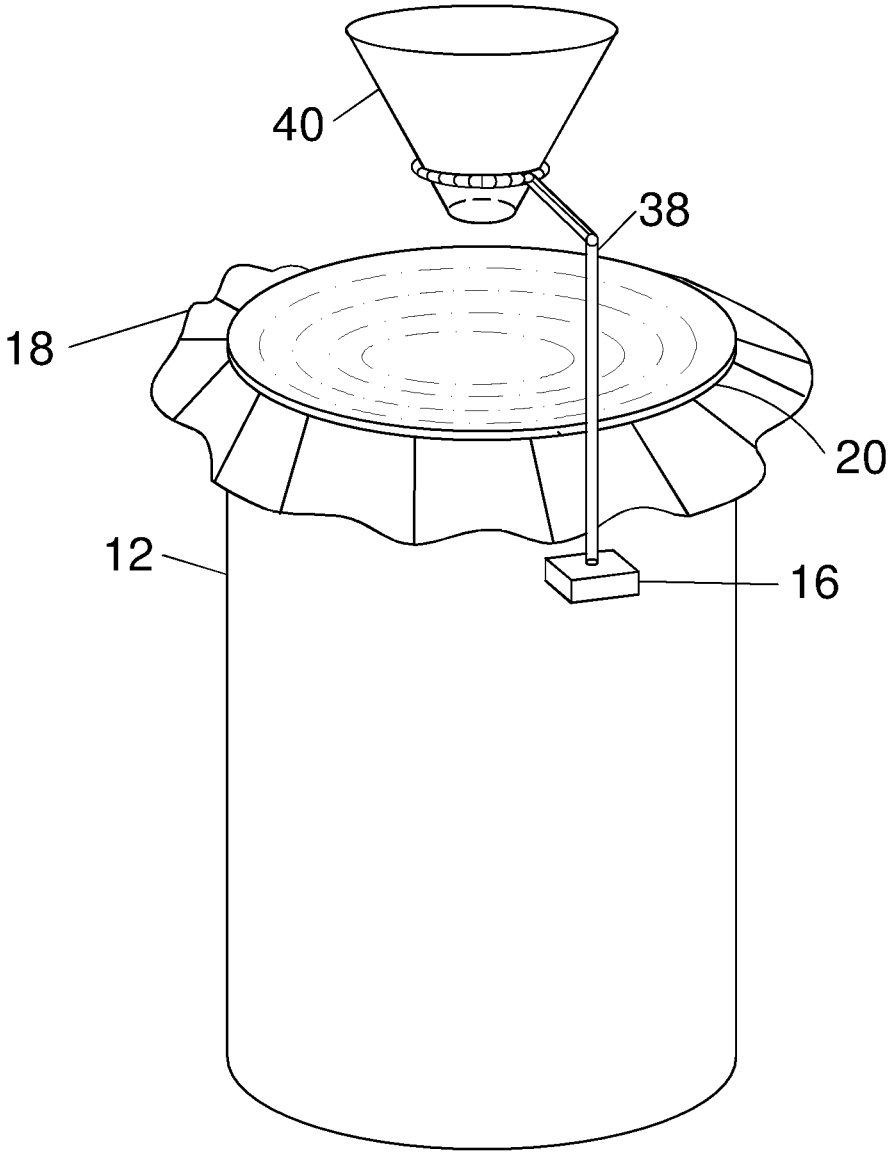

FIG. 7 An isometric view of a third embodiment.

Figure 8:
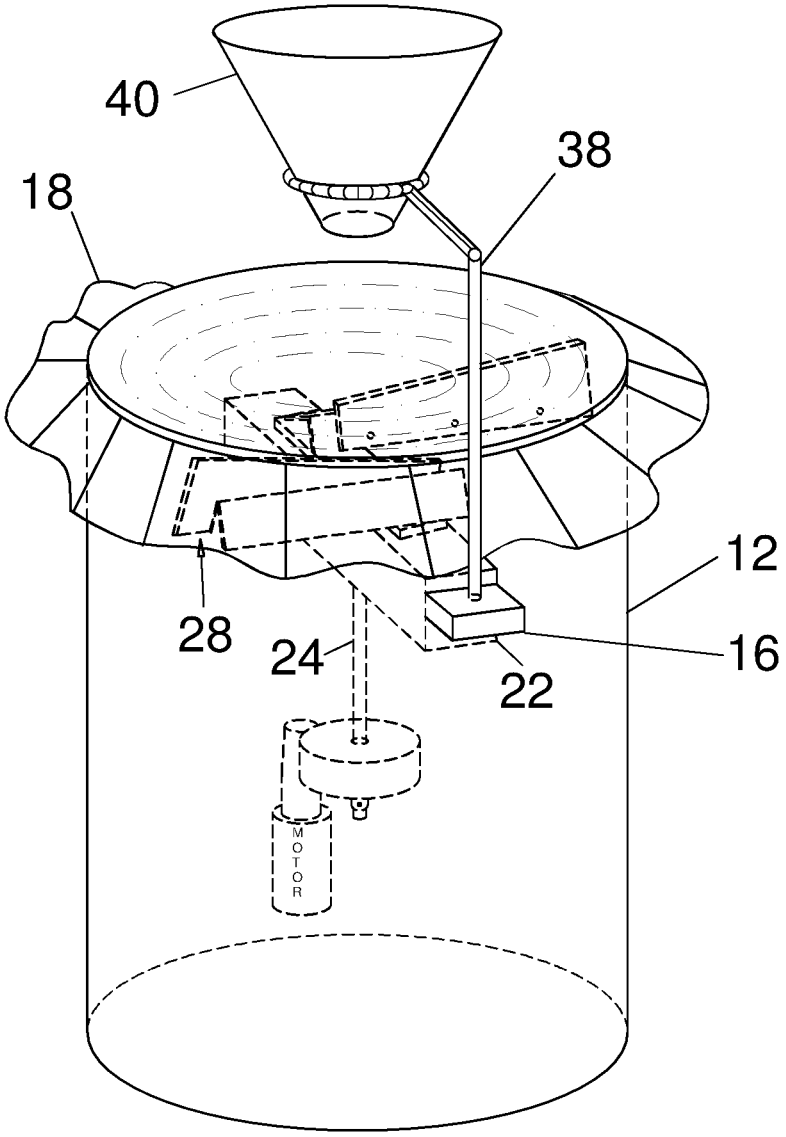

FIG. 8 An isometric view of a third embodiment with parts shown.

Figure 9:
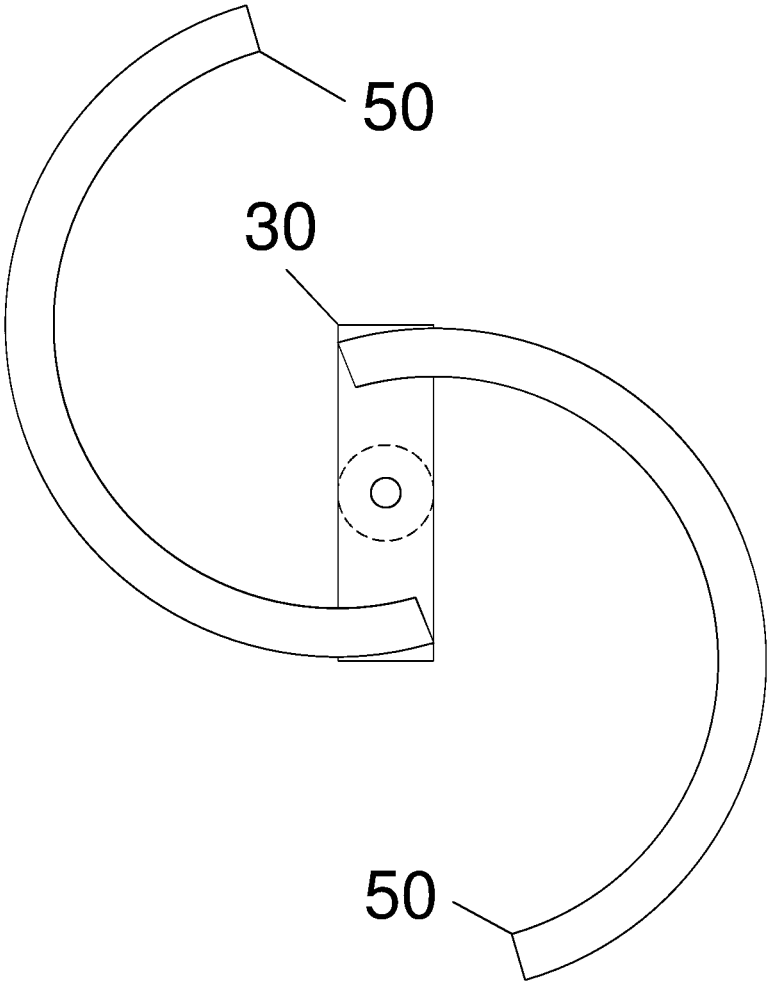

FIG. 9 A plan view of spiral arms of Embodiment 3.

Figure 10:
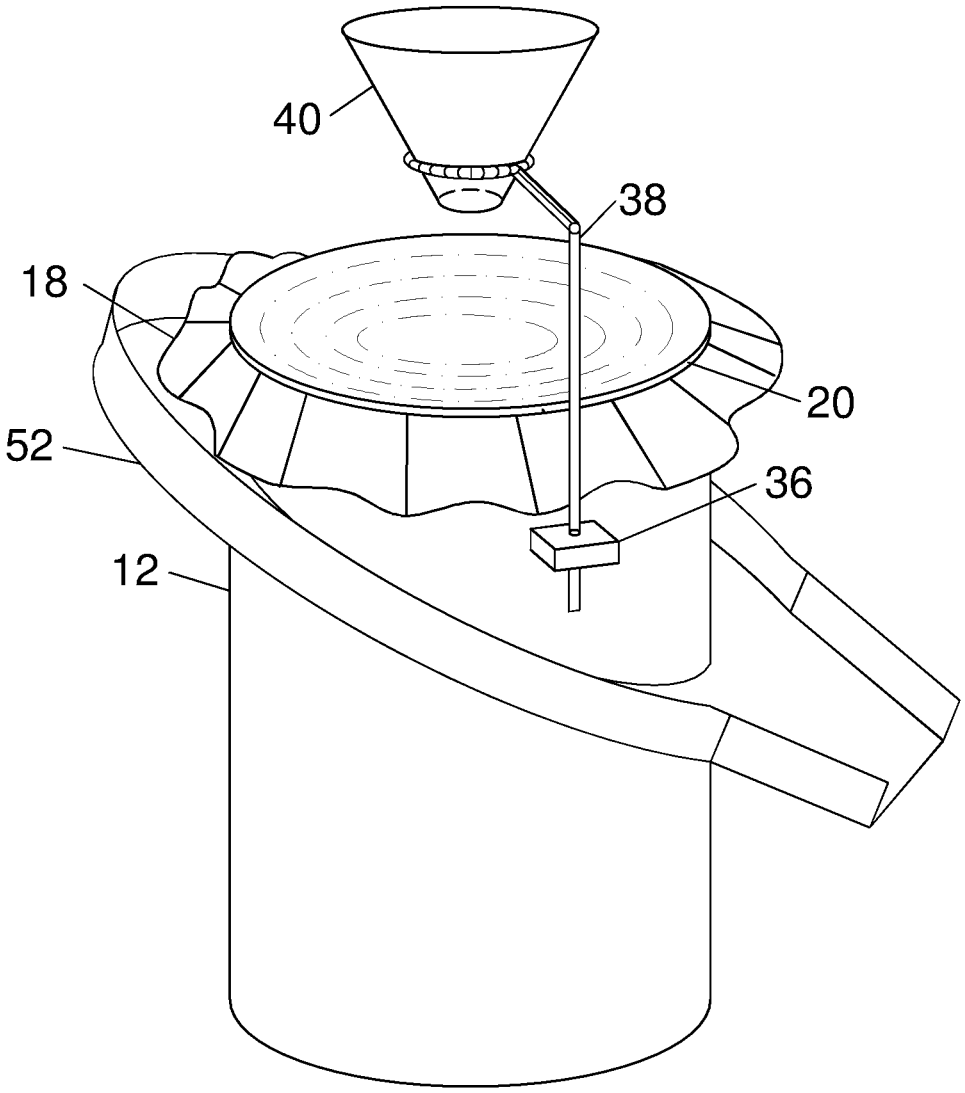

FIG. 10 An isometric view of Embodiment 4.

| DRAWINGS-REFERENCE NUMBERS | |
|---|---|
| 12. Cylindrical body | 32. Support arms |
| 14. Legs | 34. Solid lifting surfaces |
| 16. Leg mounting blocks | 36. Funnel support leg block |
| 18. Diaphragm | 38. Funnel support leg |
| 20. Clamp band | 40. Funnel |
| 22. Rigid support member | 42. Combined main leg and funnel leg mounting block |
| 24. Shaft | 44. Diaphragm mounting ring |
| 26. Bearing plates | 46. Support strut |
| 27. Thrust collar | 48. 4-way main support member |
| 28. Lifting assembly | 50. Spiral support arms |
| 30. Central hub | 52. Discharge chute |

DETAILED DESCRIPTION

First Embodiment

Shown in the drawings, FIGS. 1-4, is a gold and gemstone recovery machine comprising a cylindrical body 12 mounted on 3 legs 14. The legs are a sliding fit in blocks 16 which are fastened to the body 12. The blocks 16 are drilled and tapped for set screws. The legs support the body 12 in a vertical position. Attached across the top of the body 12 is a diaphragm 18 of low-density polyethylene. The diaphragm 18 is allowed to sag down forming a concave depression within body 12, and is attached to the body 12 with an elastic clamp band 20 around the exterior of the body 12. Within the body 12 at a predetermined distance below the top is fastened a rigid support member 22 of steel square tubing. Support member 22 extends radially across the body 12, and is drilled vertically, through the center, resulting in a hole large enough that shaft 24 can turn freely. Attached to support member 22, are two bearing plates 26. The plates are bored to be a close fit to shaft 24, and are mounted to the top and bottom of support member 22. Shaft 24 extends through both of them, and through the hole in support member 22. Shaft 24 extends upwards to a predetermined distance below the top of the body 12. A thrust collar 27 is attached to shaft 24 such that the shaft 24 can slide within it. The collar 27 has a set screw allowing the collar 27 to be locked to the shaft 24 once the shaft 24 is adjusted to the correct vertical position. The collar 27 bears against the top surface of the upper bearing plate 26. Attached at the top of shaft 24, with a sliding fit, is a lifting assembly 28 consisting of a rectangular central hub 30, which is fastened to the shaft 24 with a set screw, and rotates in concert with shaft 24. Assembly 28 also includes the support arms 32, and the lifting surfaces 34. The lower end of the shaft 24 extends below the rigid support member 22 far enough to allow attachment of the means for rotation of the shaft 24. In this embodiment, an electric motor (labeled). Attached to the top surface of the central hub 30 are two support arms 32 of angle iron, with the legs down, and fastened to the central hub 30, such that the rotationally leading edge of each support arm 32 is sloped back from the direction of rotation. The arms 32 extend, radially, in opposite directions, and extend radially nearly to, but not in contact with, the inside perimeter of the body 12.

The mounting points, along the length of the hub 30, of the arms 32, are such that the corner of the angle formed by the legs of each arm 32 is offset from the radial center of the hub 30. Attached to the arms 32 are flat, solid lifting surfaces 34 of UHMW plastic. The lifting surfaces 34 are mounted such that their inside end does not extend radially beyond the radial center of the hub 30. Each lifting surface 34 extends outward, radially, to the approximate outer end of the support arm 32. The upper edge of each lifting surface 34 is angled to approximately follow the slope of the diaphragm 18. The lifting assembly 28 is adjusted on the shaft 24 such that the lifting surfaces 34 are in light contact with the bottom surface of the diaphragm 18. Attached to the outside of the body 12 is an additional block 36, which allows a sliding mount of the funnel support leg 38 of a supply funnel 40. The support leg 38 is bent at a roughly 90 degree angle such that there is a vertical portion and a horizontal portion. The horizontal portion is attached to the funnel, and the vertical portion is a sliding mount in block 36.

It will be appreciated that the configuration of this embodiment, as outlined, may be considerably varied, as to both minor construction details, and also in materials used to construct the machine.

Steel was utilized, for the most part, other than the diaphragm 18, and the lifting surfaces 34. In most cases, either aluminum, or an appropriate plastic could be substituted for the steel parts, and, for some parts, even wood could be utilized. UHMW plastic was selected for the lifting surfaces 34 because it is self-lubricating, and thus low in friction. After much experimentation, it was decided to use low-density polyethylene for the diaphragm 18, but other waterproof fabrics were also used with good success, though they cost more. In actuality, any tightly-stitched flexible fabric, or monolithic material, even leather, can be used for dry operation, and the same fabric, in a waterproof material, can be used when operating wet. Low-density polyethylene is nice because it's cheap and readily available, though it doesn't wear as well, so needs to be replaced more often.

Operation

Operation of the machine is simple, though there are some factors to consider. The machine is set up by adjusting the legs 14 so that the upper end of the body is level. The machine is turned on, and a supply of raw material is entered into the supply funnel 40. As the concave depression of the diaphragm 18 becomes filled with material, the diaphragm 18 comes into firmer contact with the lifting surfaces 34 beneath. A ridge FIG. 5 is formed in the diaphragm 18 where it is in contact with each lifting surface 34. The ridges revolve as shaft 24 rotates. Each revolution of the ridges causes a repeated lifting, separation, and agitation of the raw material on the diaphragm 18. This repeated lifting and dropping of the diaphragm 18 is the essence of the operation, though the operation is not complete. As the raw material undergoes the lifting, separation, and agitation, the heavy materials settle down through the bulk of the material, and end up in contact with the top surface of the diaphragm 18. The diaphragm 18, forming the concave depression within the body of the machine, slopes toward the center. Thus the heavy material, under the force of gravity and agitation tends to move inwardly, down the slope, towards the center. The direction of this motion is contrary to the direction of motion of the waste material. The light material, not being in contact with the diaphragm 18, moves down the slope of the pile to the perimeter, where it falls over the side.

The upper edges of the lifting surfaces 34 are offset from the radial center of the lifting assembly 28. The result of the offset is that any outward point along the diaphragm contact edge of each lifting surface 34 leads, radially, as the assembly 28 rotates, any more inward point. The effect of that is the diaphragm 18 is lifted outwardly, by each ridge, before it is lifted more inwardly. Thus the slope of the diaphragm 18 is increased as the ridge passes. That increased slope occurs as a motion going from the perimeter of the diaphragm 18, and moving towards the center. That motion urges the material in contact with the diaphragm 18, to accelerates its movement toward the center. The overall effect is a sweeping action that drives the heavy material to the center, and holds it there. The greater the offset distance, the greater the sweeping force.

When dealing with materials like gemstones, there are relatively small differences between the specific gravity of the stones, and the specific gravity of the general raw material, or gangue.

Also, when dealing with true flour gold, that is gold that is below 50 mesh in size, and has an extremely flat shape, the gold, while having a large difference in specific gravity, acts as though the difference is slight. In fact, in some circumstances, gold may settle slower than gemstones when being concentrated. My experiments have shown that the only way to separate these materials of slight specific gravity differences is to use a gentle action when agitating the raw material. Any harsh movement of the pulp or gangue has a tendency to "float" these materials, of slight difference in specific gravity, back into the waste stream, where they are often lost.

The point of the last paragraph is to emphasize the rather gentle up-and-down motion of the pulp or gangue resulting from the movement of the ridges, and the positive effect of the sweeping action of the offset lifting surfaces. The effect of overdoing the sweeping force is that it may cause an upwelling of the recovered material in the center, thus pushing the desired material back up and into the waste stream. I recommend the offset of the inward end of the upper edge of the lifting surfaces 34, be no more than approximately 20% of the diaphragm 18 radius, though more, or less, may be required for some uses, and depending on the material being worked.

Another factor to consider is the rotation speed of the lifting assembly 28. It isn't desirable to have the lifting ridge throwing material off the diaphragm. I've found a good speed of rotation is one that finds the outward end of the lifting surfaces 34 moving at approximately 270 feet/minute, though the operator may experiment for the optimal recovery on the particular raw material being run.

The machine, when used dry for gems, has its best efficiency when the raw material that is smaller then the smallest gem wanting to be retained, is screened-out before the raw material is fed to the machine. This may not be required in every circumstance and is dependent on the nature of the raw material being run. It also may not be required when operating the machine wet. When operated dry, the optimal supply rate is one that finds the supplied material forming a conical pile in the center of the diaphragm 18, the sides of which slope at approximately 10 degrees to the horizontal towards the perimeter.

When operating with water, the pile may have somewhat less slope to the perimeter due to the reduced friction in the wet material. Operating the machine wet may be required any time the raw material is not completely dry, or when the material is clumpy, and water is needed to break it down.

In both cases the water is doing nothing more than ensuring that the very small gems and flour gold, do not stick to the unwanted material, and are allowed to settle. The water has no effect, either positive or negative on the recovery process. It is recommended that the water be introduced at the supply funnel 40, and be allowed to sink into the raw material, where it will become approximately level with the perimeter of the diaphragm 18, with the excess flowing over the side. The water input should not be such that the water carries any material across the surface of the pile.

The lifting, separation, and agitation of the raw material results in movement of the waste under the force of gravity. The rate of supply impacts the height of the pile of raw material, and thus how quickly the material moves toward the perimeter. Having the supply too fast may result in some desired material being lost to waste.

The rate of supply can be controlled, to some extent, by the height of the supply funnel 40 above the center of the diaphragm. The machine will self-control to some extent, dependent on the height of the funnel.

Depending on the amount of desired material in the raw material, it is recommended to remove and empty the diaphragm 18 periodically. The diaphragm 18 should be removed, emptied into a tub for further processing, and reinstalled.

Additional Embodiment 1

Description

This embodiment is shown in FIG. 6. The cylindrical body 12 has been replaced with diaphragm mounting ring 44. Supporting the mounting ring 44 are four vertical support struts 46. These support struts 46, are, in turn, supported by the main support member 48. The support member 48 is supported by four legs 14. Three of the legs are mounted in the blocks 16 such that they can be slid up or down until the diaphragm support ring 44, is approximately level. The blocks are fastened to the ends of the main support member 48. The fourth leg is mounted the same way, but in block 42 which also provides a mount for the funnel support leg 38.

Additional Embodiment 1

Operation

There is no change of operation with embodiment 1.

Additional Embodiment 2

Description

This embodiment is shown in FIGS. 7-8. The only change is replacing of legs 14 and leg mounting blocks 16. The cylindrical body 12 is simply extended to act as legs. One block 36 remains to mount the funnel support leg 38.

Additional Embodiment 2

Operation

There is no change in operation with embodiment 2.

Additional Embodiment 3

Description

This embodiment is shown in FIG. 9. It comprises changing the shape of the support arms 32 to a curved, spiral shape. The lifting surfaces 34 are changed to match the support arms.

Additional Embodiment 3

Operation

There is no change in operation with embodiment 3.

Additional Embodiment 4

Description

This embodiment is shown in FIG. 10. It comprises a wrap-around discharge chute 52.

Additional Embodiment 4

Operation

This embodiment gives the advantage of a directed waste discharge.

Additional Embodiment 5

Description

This embodiment would be the addition of a vibrating element at any point in the machine.

Additional Embodiment 5

Operation

The vibrating element helping to break down hard lumps of material and free the small desired fraction. Also, the vibration would hasten the overall movement of material.

CONCLUSION, RAMIFICATIONS, AND SCOPE

From the foregoing, it can be seen that this machine is well composed to accomplish the goals set forth. Among the advantages are simple design, easy maintenance, light weight when built in small sizes, and the ability to be operated in either wet or dry modes. In addition this machine is capable of recovery of materials, wet or dry, of only a slight density increase over the pulp or gangue, including gemstones of any variety, and micron gold. It accomplishes this without the use of dangerous chemicals. This machine, however, should not be limited in scope to minerals. It could serve to separate materials in any industry where that purpose is required.

While my description, above, contains specificities, these should not be construed as limitations on the scope, but instead as the exemplification of one embodiment. Other variations are possible. Such variations may include but are not limited to, such items as materials used in its construction, the shape of some parts, and the method of powering the machine.

Accordingly, the scope should be determined not by any particular embodiment, but rather by the appended claims and their legal equivalents.

I claim:

1. A machine for the wet or dry separation and retention of heavier materials from pulp or gangue containing such heavier materials comprising:

a. a cylindrical body having a vertical shaft running axially and having a means to convey rotation to said shaft, and b. said shaft attached at the upper end to a lifting assembly which rotates in concert with the shaft, and c. said cylindrical body having attached, at its upper periphery, a flexible diaphragm having both a topside and underside, said diaphragm sloping down to the center forming a concave depression within the cylindrical body, and d. said lifting assembly is in contact with the underside of said diaphragm, and is shaped such that its contact with the underside of the diaphragm causes an upward projecting ridge, or ridges in the diaphragm, and f. the concave depression formed by said diaphragm is supplied at the center, from above the center, by external means, a flow of pulp or gangue containing the heavier materials desired to be separated and retained, and g. said supplied pulp or gangue forming a conical pile on the topside of said diaphragm, the sides of which slope downward to the perimeter of the diaphragm, and h. said ridge, or ridges rotating in concert with the lifting assembly, causes the repeated lifting, separation, and agitation of the pulp or gangue, which lifting, separation, and agitation of the pulp or gangue allows the heavier materials to sink through the pulp or gangue until contacting the topside of said diaphragm, while the agitation of the pulp or gangue causes the lighter portions of said pulp or gangue to travel down the slope of said conical pile, flow over the perimeter of the diaphragm, and out to waste, and i. said heavier materials, once in contact with said diaphragm, slide down the slope of the diaphragm to the lowest point of said concave depression, whereby said heavier materials have been separated from the majority of the pulp or gangue and are retained.

2. The machine of claim 1 wherein the said lifting assembly is comprised of any number of support arms extending radially outward a predetermined distance from a central hub.

3. The machine of claim 2 wherein said support arms originate at a point on the central hub that is offset from the radial center of said hub.

4. The machine of claim 2 wherein said support arms have flat solid lifting surfaces attached.

5. The machine of claim 4 wherein said lifting surfaces slope back from the direction of rotation.

6. A method for the separation and retention of heavier materials from lighter materials based on their differences in specific gravity comprising:

(a) providing a flexible diaphragm attached to the upper periphery of a cylindrical body, and (b) said diaphragm sloping downward towards the center forming a bowl-shaped depression within the upper confines of said cylindrical body, and (c.) said depression supplied from above, and at the center, forming a conical mound of pulp or gangue containing the heavier materials to be separated and retained, and (d) providing a rotating lifting assembly, rotated by an attached vertical shaft running axially within the cylindrical body, and rotated by appropriate means, and (e) said lifting assembly, by its shape, urges an upward projecting ridge or ridges in said diaphragm, and (f) said ridge in said diaphragm rotates in concert with said lifting assembly, causing repeated lifting, separation, and agitation of said pulp or gangue, and (g) said lifting, separation, and agitation of the pulp or gangue allows the heavier materials to sink through the pulp or gangue until contacting said diaphragm, and (h.) said lifting assembly having support arms which originate at a point offset from the radial center of the lifting assembly, which offset results in any outward point on said arms to lead any more inward point, as they rotate, thus causing said upward projecting ridge in said diaphragm to have the effect of moving materials in contact with the ridge angularly towards the center rather than simply at a tangent to the circle of rotation, and (i.) said angular movement being in a direction contrary to the movement direction of the waste, (j.) said lifting, separation, and agitation, at the same time, causing the lighter unwanted material to move, by gravity, down the side of said conical mound to the perimeter of the diaphragm, where it falls over the edge to the waste pile, whereby the heavier materials are separated and retained.

* * * * *